US010563461B2

(12) United States Patent
Nanayakkara

(10) Patent No.: US 10,563,461 B2
(45) Date of Patent: Feb. 18, 2020

(54) HYBRID DRIVE FOR A FULLY ROTATING DOWNHOLE TOOL

(71) Applicant: Halliburton Energy Services, Inc., Houston, TX (US)

(72) Inventor: Ravi P. Nanayakkara, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 56 days.

(21) Appl. No.: 15/756,481

(22) PCT Filed: Oct. 12, 2015

(86) PCT No.: PCT/US2015/055144
§ 371 (c)(1),
(2) Date: Feb. 28, 2018

(87) PCT Pub. No.: WO2017/065738
PCT Pub. Date: Apr. 20, 2017

(65) Prior Publication Data

US 2018/0252042 A1 Sep. 6, 2018

(51) Int. Cl.
*E21B 7/06* (2006.01)
*E21B 4/02* (2006.01)
(Continued)

(52) U.S. Cl.
CPC ..... *E21B 7/068* (2013.01); *E21B 4/02* (2013.01); *E21B 4/04* (2013.01); *E21B 7/067* (2013.01); *E21B 41/0085* (2013.01)

(58) Field of Classification Search
CPC ..... E21B 7/067; E21B 7/068; E21B 41/0085; E21B 4/04; E21B 4/02
See application file for complete search history.

(56) References Cited

U.S. PATENT DOCUMENTS 4,509,091 A 4/1985 Booth
5,133,696 A 7/1992 Kobayashi
(Continued)

FOREIGN PATENT DOCUMENTS

EP 0772724 B1 8/1999
WO 2013/062409 A1 5/2013

OTHER PUBLICATIONS

International Search Report and Written Opinion issued in related PCT Application No. PCT/US2015/055144 dated Jul. 4, 2016, 16 pages.

(Continued)

*Primary Examiner* — Kristyn A Hall
(74) *Attorney, Agent, or Firm* — Alan Bryson; Baker Botts L.L.P.

(57) ABSTRACT

In accordance with embodiments of the present disclosure, a hybrid drive for use within a rotary steerable drilling tool is provided. The hybrid drive may enable improved directional drilling performance of the rotary steerable drilling tool. The hybrid drive may include a prime mover for rotating a drilling component (e.g., cam used to counter-rotate a steering head) relative to a fully rotating outer housing of the rotary steerable tool. In addition, the hybrid drive may include an electrical motor/generator for adjusting the rotational speed of the cam in response to high frequency changes in rotational speed of the tool housing. The hybrid drive may also include a transmission coupled to the prime mover and the electrical motor/generator for providing mechanical energy from one or both of the prime mover and the motor/generator to rotate the cam (or other drilling component) within the rotary steerable tool.

20 Claims, 4 Drawing Sheets

(51) Int. Cl.
*E21B 4/04* (2006.01)
*E21B 41/00* (2006.01)

(56) References Cited

U.S. PATENT DOCUMENTS

| | | | |
|---|---|---|---|
| 5,943,918 | A | 8/1999 | Reed, Jr. et al. |
| 6,092,610 | A | 7/2000 | Kosmala et al. |
| 6,109,372 | A | 8/2000 | Dorel et al. |
| 6,997,271 | B2 | 2/2006 | Nichols et al. |
| 7,166,049 | B2 | 1/2007 | Saller |
| 7,201,239 | B1 | 4/2007 | Perry |
| 7,300,380 | B2 | 11/2007 | Iwatsuki et al. |
| 7,481,281 | B2 | 1/2009 | Schauf |
| 7,571,643 | B2 | 8/2009 | Sugiura |
| 7,687,950 | B2 | 3/2010 | Kuckes |
| 7,699,102 | B2 | 4/2010 | Storm et al. |
| 7,913,773 | B2 | 3/2011 | Li et al. |
| 8,033,328 | B2 | 10/2011 | Hall et al. |
| 8,426,988 | B2 | 4/2013 | Hay |
| 8,622,153 | B2 | 1/2014 | McLoughlin et al. |
| 8,689,906 | B2 | 4/2014 | Nessjoen et al. |
| 2005/0126775 | A1* | 6/2005 | Van Nguy ..... E21B 17/06 166/125 |
| 2006/0081399 | A1* | 4/2006 | Jones ..... E21B 7/04 175/61 |
| 2011/0266063 | A1 | 11/2011 | Downton |
| 2013/0049982 | A1 | 2/2013 | Hartmann |
| 2013/0291830 | A1 | 11/2013 | Doering et al. |
| 2015/0263575 | A1* | 9/2015 | Pace ..... B66D 1/12 166/355 |

OTHER PUBLICATIONS

International Preliminary Report on Patentability issued in related PCT Application No. PCT/US2015/055144 dated Apr. 26, 2018, (13 pages).

* cited by examiner

HYBRID DRIVE FOR A FULLY ROTATING DOWNHOLE TOOL

CROSS-REFERENCE TO RELATED APPLICATION

The present application is a U.S. National Stage Application of International Application No. PCT/US2015/055144 filed Oct. 12, 2015, which is incorporated herein by reference in its entirety for all purposes.

TECHNICAL FIELD

The present disclosure relates generally to downhole drilling tools and, more particularly, to a hybrid drive for use in a downhole drilling tool.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

Many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the borehole geometry. In the exploration and recovery of subsurface hydrocarbon deposits, such as petroleum and natural gas, the directional borehole is typically drilled with a rotatable drill bit that is attached to one end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often including jointed pipe or relatively flexible "spoolable" tubing, also known as "coiled tubing." This directional drilling system—i.e., the operatively interconnected tubing, drill bit, and BHA—can be referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Directional drilling typically requires controlling and varying the direction of the wellbore as it is being drilled. Oftentimes the goal of directional drilling is to reach a position within a target subterranean destination or formation with the drill string. For instance, the drilling direction may be controlled to direct the wellbore towards a desired target destination, to control the wellbore horizontally to maintain it within a desired payzone, or to correct for unwanted or undesired deviations from a desired or predetermined path.

Various options are available for providing steering capabilities to a drilling tool for controlling and varying the direction of the wellbore. For example, directional drilling may also be accomplished with a "rotary steerable" drilling system wherein the entire drill pipe string is rotated from the surface, which in turn rotates the BHA, including the drill bit, connected to the end of the drill pipe string. In a rotary steerable drilling system, the drill string may be rotated while the drilling tool is being steered either by being pointed or pushed in a desired direction (directly or indirectly) by a steering device.

Some rotary steerable drilling systems may be "fully rotating", meaning that the entire system is designed to rotate along with the drill pipe. In such fully rotating systems, it can be desirable to maintain a geostationary reference point (for the desired direction) and mounting location for one or more steering components within the fully rotating rotary steerable system, to keep the bit pointed in a particular direction relative to the formation while drilling.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
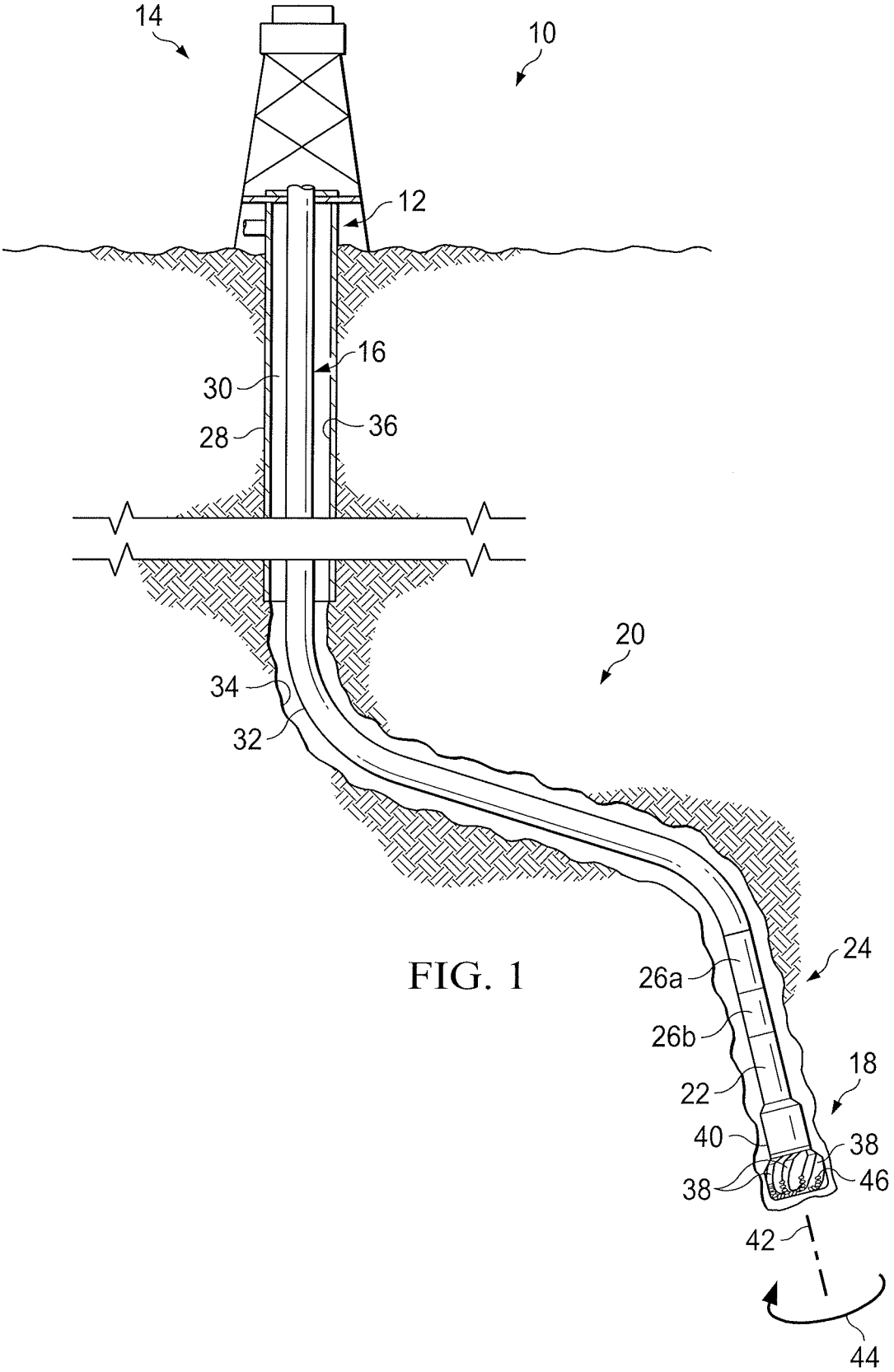
FIG. 1 is a schematic illustration of a drilling system including a fully rotating rotary steerable tool, in accordance with an embodiment of the present disclosure.

Illustrative embodiments of the present disclosure are described in detail herein. In the interest of clarity, not all features of an actual implementation are described in this specification. It will, of course, be appreciated that in the development of any such actual embodiment, numerous implementation-specific decisions must be made to achieve developers' specific goals, such as compliance with system-related and business-related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for providing a hybrid drive within a downhole drilling tool (e.g., rotary steerable drilling tool). This hybrid drive may enable improved directional drilling performance of the rotary steerable drilling tool.

A rotary steerable drilling system may be used with directional drilling systems for steering a drill bit to drill a non-vertical wellbore. Fully rotating rotary steerable drilling systems generally include components that are all designed to rotate along with the drill pipe coupled above the BHA. In such systems, however, it is desirable to maintain a mounting point for a "steering head" (which points the drill bit) in a geostationary orientation relative to the subterranean formation while the system is rotating. At this mounting location, a cam can be used to counter-rotate the steering head with respect to the fully rotating outer housing of the system. That is, the cam may be rotated in a direction opposite the rotation of the housing and other components of the fully rotating tool. This counter-rotation helps to keep the steering head geostationary with respect to the subterranean formation through which the system is directed. Unfortunately, such counter-rotation can be difficult to control due to vibrations, stick-slip, and other torque interruptions experienced downhole.

The disclosed system may include a hybrid drive disposed within a fully rotating rotary steerable tool to maintain the steering head in a desired geostationary orientation. The hybrid drive may include a prime mover for rotating a drilling component (e.g., cam used to counter-rotate the steering head) relative to the rotating outer housing. The prime mover may be a turbine that harnesses energy from drilling mud flowing through the rotary steerable tool. In addition, the hybrid drive may include an electrical motor/generator for adjusting the rotational speed of the cam in response to high frequency changes in rotational speed of the tool housing. The hybrid drive may also include a transmission coupled to the prime mover and the electrical motor/generator for providing mechanical energy from one or both of the prime mover and the motor/generator to rotate the cam (or other drilling component) within the rotary steerable tool.

The hybrid drive may be used to more closely match the rotational speed of the fully rotating housing, as compared to systems that rely on just a prime mover to counter-rotate the cam. That is, the electrical motor/generator may be coupled in series with the prime mover to compensate for rapid acceleration or deceleration of the rotary steerable tool rotation. Sudden acceleration or deceleration of the system (due to stick-slip and other disturbances) may be detected via sensors, and a control system may operate the electrical motor/generator to adjust the rotational speed of the cam to match the speed of the entire system. By correcting for these disturbances, the disclosed hybrid drive may facilitate better drilling performance and toolface control than is available through existing fully rotating systems. In addition, the hybrid drive may enable higher build rates, lower wear of drilling components, higher reliability of the tool, and a better overall borehole quality because of the accurate geostationary positioning of the steering head.

In some embodiments, the disclosed electrical motor/generator of the hybrid drive may be selectively operated as a regenerative drive to provide electrical energy to an energy storage device within the rotary steerable tool. This regenerated and stored electrical energy may provide relatively lower power consumption levels in the disclosed rotary steerable tool, making the system more efficient.

Turning now to the drawings, FIG. 1 is a schematic illustration of a drilling system 10 in accordance with the presently disclosed embodiments. The drilling system 10 may include a well surface or well site 12. Various types of drilling equipment such as a rotary table, drilling fluid pumps and drilling fluid tanks (not expressly shown) may be located at the well site 12. For example, the well site 12 may include a drilling rig 14 that has various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

The drilling system 10 may also include a drill string 16 associated with a drill bit 18 that may be used to form a wide variety of wellbores or bore holes such as a generally diagonal or directional wellbore 20. The term "directional drilling" may be used to describe drilling a wellbore or portions of a wellbore that extend at a desired angle or angles relative to vertical. The desired angles may be greater than normal variations associated with vertical wellbores. Directional drilling may be used to access multiple target reservoirs within a single wellbore 20 or reach a reservoir that may be inaccessible via a vertical wellbore. A rotary steerable drilling system 22 may be used to perform directional drilling. The rotary steerable drilling system 22 may use a point-the-bit method to cause the direction of drill bit 18 to vary relative to the housing of the rotary steerable drilling system 22 by bending a cylindrical component (e.g., sonde 84 shown in FIG. 2) running through the rotary steerable drilling system 22.

A bottom hole assembly (BHA) 24 may include a wide variety of components configured to form the wellbore 20. For example, components 26*a* and 26*b* of the BHA 24 may include, but are not limited to, drill bits (e.g., drill bit 18), coring bits, drill collars, rotary steering tools (e.g., rotary steerable drilling system 22), directional drilling tools, downhole drilling motors, reamers, hole enlargers or stabilizers. The number and types of components 26 included in the BHA 24 may depend on anticipated downhole drilling conditions and the type of wellbore that will be formed by the drill string 16 and the rotary drill bit 18. The BHA 24 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools and/or any other commercially available well tool. Further, the BHA 24 may also include a rotary drive (not expressly shown) connected to the components 26*a* and 26*b* and which rotates at least some of the components 26*a* and 26*b*.

The wellbore 20 may be defined in part by a casing string 28 that may extend from the well surface 12 to a selected downhole location. Portions of the wellbore 20, as shown in FIG. 1, that do not include the casing string 28 may be described as "open hole." Various types of drilling fluid may be pumped from the well surface 12 downhole through the drill string 16 to the attached drill bit 18. "Uphole" may be used to refer to a portion of the wellbore 20 that is closer to the well surface 12 and "downhole" may be used to refer to a portion of the wellbore 20 that is further from the well surface 12 along the length of the wellbore 20. The drilling fluids may be directed to flow from the drill string 16 to respective nozzles passing through the rotary drill bit 18.

The drilling fluid may be circulated uphole to the well surface 12 through an annulus 30. In open hole embodiments, the annulus 30 may be defined in part by an outside diameter 32 of the drill string 16 and an inside diameter 34 of the wellbore 20. In embodiments using the casing string 28, the annulus 30 may be defined by the outside diameter 32 of the drill string 16 and an inside diameter 36 of the casing string 28.

The drilling system 10 may also include a rotary drill bit ("drill bit") 18. Although the drill bit 18 is illustrated as being a PDC (polycrystalline diamond compact) drag drill bit, other embodiments of the drilling system 10 may utilize a roller cone drill bit having at least one and up to any desirable number of roller cones designed to rotate with respect to a journal arm of the bit, in response to drilling mud being pumped through the bit. In the illustrated embodiment, the drill bit 18 may include one or more blades 38 that may be disposed outwardly from exterior portions of a rotary bit body 40 of the drill bit 18. The blades 38 may be any suitable type of projections extending outwardly from the rotary bit body 40. The drill bit 18 may rotate with respect to a bit rotational axis 42 in a direction defined by directional arrow 44. The blades 38 may include one or more cutting elements 46 disposed outwardly from exterior portions of each blade 38. The blades 38 may also include one or more depth of cut controllers (not expressly shown) configured to control the depth of cut of the cutting elements 46. The blades 38 may further include one or more gage pads (not expressly shown) disposed on the blades 38. The drill bit 18 may have many different designs, configurations, and/or dimensions according to the particular application of the drill bit 18.

Figure 2:
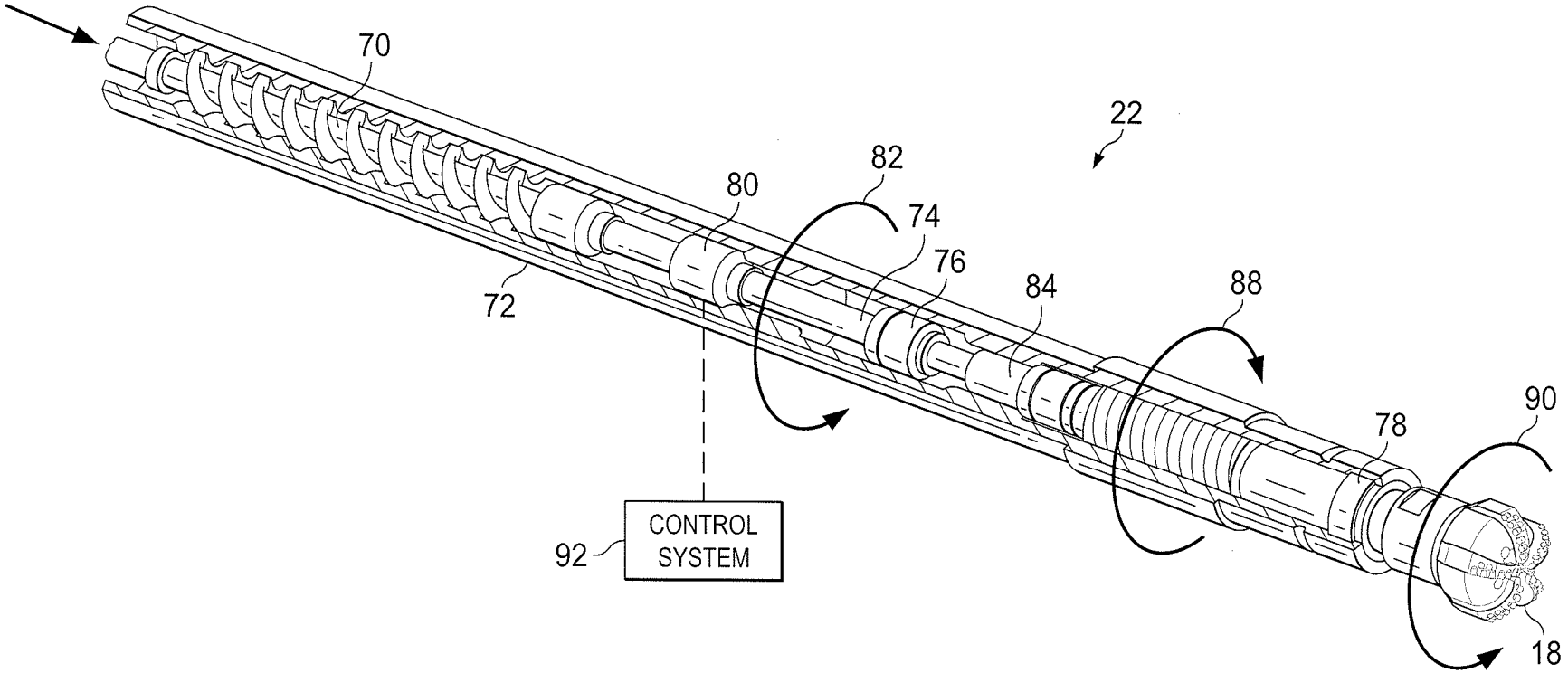
FIG. 2 is partial perspective view of a fully rotating rotary steerable tool that may utilize a hybrid drive, in accordance with an embodiment of the present disclosure.

The drill bit 18 may be a component of the rotary steerable drilling system 22, discussed in further detail in FIG. 2. The drill bit 18 may be steered by adjusting a toolface of the drill bit 18 to control the direction of the drill bit 18 to form the generally directional wellbore 20. The toolface may be the angle, measured in a plane perpendicular to the drill string axis that is between a reference direction on the drill string and a fixed reference and may be any angle between +180 degrees and −180 degrees. For a directional wellbore, the fixed reference may be the top of the wellbore 20. The toolface may be the angle between the fixed reference and the reference direction, e.g., the tip of the drill bit 18. In other embodiments, the fixed reference may be magnetic north, a line opposite to the direction of gravity, or any other suitable fixed reference point.

Some embodiments of the rotary steerable drilling system 22 may be fully rotating, such that the entire rotary steerable drilling system 22 is rotating to advance the wellbore 20. As described in detail below, it may be desirable to hold the toolface of the drill bit 18 in a geostationary position with respect to the subterranean formation through which the wellbore 20 is being drilled even as the rotary steerable drilling system 22 is fully rotating. This may enable the system to steer the drill bit 18 and to form the wellbore 20 in a desired direction. To that end, the drill bit 18 may be coupled to an internal sonde disposed within a housing of the rotary steerable drilling system 22, and the sonde may be counter-rotated relative to the overall rotation of the rotary steerable drilling system 22. This may maintain the toolface of the drill bit 18 in a desired position relative to the formation by keeping the sonde and the toolface geostationary.

In general, a speed of rotation of the rotary steerable drilling system 22 may be controlled such that the speed is relatively constant. However, while performing a drilling operation, disturbances (e.g., vibrations, stick-slip, bit walk, bit whirl, bit bounce, torsional disturbances, lateral forces from the formation, the presence of formation cuttings, or any other cause of a tool rotation anomaly) may cause the rotary steerable drilling system 22 to deviate from the desired rotational speed. This can make it difficult for the sonde 84, drill bit 18, or other downhole components to be counter-rotated at a matching speed to maintain a desired toolface.

Therefore, it may be advantageous to control the toolface by incorporating a hybrid drive for powering the counter-rotation of the drill bit 18 as the system is fully rotated. This hybrid drive may compensate for disturbances acting on the drill bit 18 and the dynamics of the rotary steerable drilling system 22 in order to maintain the desired toolface, as discussed in detail below. The hybrid drive may be located downhole, as a component of the rotary steerable drilling system 22. The rotary steerable drilling system 22 including the hybrid drive designed according to the present disclosure may improve the accuracy of steering the drill bit 18 by accounting for and mitigating the effect of downhole vibrations on the toolface. A toolface that is closer to the desired toolface may also improve the quality of the wellbore 20 by preventing the drill bit 18 from deviating from the desired toolface throughout the drilling process. Additionally, the rotary steerable drilling system 22 including a hybrid drive designed according to the present disclosure may improve tool life and drilling efficiency of the drill bit 18 due to the ability to increase the speed of drilling and decrease the cost per foot of drilling.

FIG. 2 illustrates a perspective view of the rotary steerable drilling system 22 having a hybrid drive 68 in accordance with an embodiment of the present disclosure. The rotary steerable drilling system 22 may include a turbine 70, a housing 72, an inner shaft 74, an eccentric cam 76, thrust bearings 78, and the drill bit 18. In addition, the rotary steerable drilling system 22 may include an electrical motor/generator 80 disposed along the inner shaft 74. The hybrid drive 68 of the rotary steerable drilling system 22 may include both the turbine 70 and the electrical motor/generator 80, which are connected via the inner shaft 74 to a transmission (not shown) to control counter-rotation of other internal components of the system.

In some embodiments, the housing 72 may rotate with a drill string, such as the drill string 16 shown in FIG. 1. For example, the housing 72 may rotate in a direction 82, which may in turn cause the drill bit 18 to rotate and form the wellbore 20 shown in FIG. 1. In the illustrated embodiment, the entire length of the housing 72 may be designed to rotate along with the drill string, in order to provide a fully rotating rotary steerable drilling system 22. In fully rotating systems 22, all the parts of the system 22 (or at least the housing 72) may rotate together in the same direction 82, thereby preventing undesirable sliding friction and/or sticking between the parts that make up the fully rotating system.

The drill bit 18 may be arranged onto the end of a sonde 84 (i.e., cylindrical assembly) extending from the eccentric cam 76 and held within the fully rotating housing 72. The eccentric cam 76 may be used to bend or orient the sonde 84 such that the sonde 84 points the drill bit 18 in a desired direction relative to the formation. Once the sonde 84 is positioned to point the drill bit 18 in a specific direction via the eccentric cam 76, it may be desirable to keep the sonde 84 geostationary with respect to the formation. Specifically, the geostationary sonde 84 may maintain the drill bit 18 at a desired toolface, thereby keeping the drill bit 18 pointed in a certain direction for advancing the wellbore. In addition, some embodiments of the sonde 84 may include sensors such as accelerometers that may be utilized to take downhole measurements under geostationary conditions. Even as the sonde 84 is maintained in a geostationary position, the entire rotary steerable drilling system 22 may still be fully rotating.

To maintain a desired toolface while the housing 72 rotates, the hybrid drive 68 may be used to rotate the cam 76 and the sonde 84 relative to the housing 72. Specifically, the hybrid drive 68 may rotate the cam 76 and the sonde 84 in the opposite direction of, and at the same speed as, the rotation of the housing 72. For example, the cam 76 and sonde 84 may rotate in a direction 88 at or near the same speed the housing 72 rotates in the direction 82.

The hybrid drive 68 may utilize the turbine 70 and the electrical motor/generator 80 to provide rotary power for counter-rotating the cam 76 and the sonde 84 with respect to the rotating housing 72. In such embodiments, the turbine 70 may function as a "prime mover" for converting mechanical energy from the flow of drilling mud through the rotary steerable drilling system 22 to rotary energy for rotating the inner shaft 74. The electrical motor/generator 80 may also provide power for rotating the inner shaft 74.

A valve (not shown) may be located uphole of the other components of the rotary steerable drilling system 22 to provide a flow rate of drilling fluid into the turbine 70. The flow rate of drilling fluid that flows into the turbine 70 may be adjusted by opening or closing the valve. The valve may be controlled by any suitable method. The flow of drilling fluid into the turbine 70 may affect the rotational speed or angular velocity of the turbine 70. The rotational speed of the turbine 70 may be directly proportional to the flow rate of drilling fluid into the turbine 70. In some embodiments, the flow rate of drilling fluid through the rotary steerable drilling system 22 may be controlled such that the resulting speed of rotation of the turbine 70 corresponds approximately to an expected average speed of rotation of the housing 72.

A control system 92 may be communicatively coupled to the electrical motor/generator 80 to adjust the speed of rotation of the inner shaft 74 provided by the turbine 70. The rotational speed of the inner shaft 74 may be affected by the flow rate of drilling fluid into the turbine 70, as well as by control signals received at the electrical motor/generator 80. The inner shaft 74 may be coupled to the turbine 70 and to the motor/generator 80. Thus, one or both of the turbine 70 and the motor/generator 80 of the rotary steerable drilling system 22 may affect the rotational speed of the inner shaft 74, which may in turn affect the rotational speed of the cam 76 and the sonde 84, as well as the toolface at the drill bit 18.

A set of planetary gears may couple the housing 72, the inner shaft 74, and the cam 76. The inner shaft 74, which is rotated in the opposite direction of the housing 72 by the turbine 70 and the motor/generator 80, may be geared to rotate the cam 76 at approximately the same speed but in the opposite direction of the housing 72. This rotation of the cam 76 may maintain the sonde 84 at a geostationary position and the toolface of the drill bit 18 at the desired angle. The positioning of the planetary gears may contribute to maintaining the desired toolface at the drill bit 18 between +180 and −180 degrees.

The eccentric cam 76 may be designed to bend the rotary steerable drilling system 22 to point the drill bit 18. The eccentric cam 76 may be any suitable mechanism that may point the drill bit 18, such as a cam, a sheave, or a disc. The thrust bearings 78 may be designed to absorb the force and torque generated by the drill bit 18 while the drill bit 18 is drilling a wellbore (e.g., wellbore 20 shown in FIG. 1). The planetary gears may be connected between the housing 72, the inner shaft 74, and the cam 76 to maintain the drill bit 18 at a desired toolface.

To point and maintain the drill bit 18 at a specified toolface, the toolface and the sonde 84 may be held in a geostationary position (e.g., the toolface remains at the same angle relative to a reference in the plane perpendicular to the drill string axis) based on the rotation of the cam 76 in an equal and opposite direction to the rotation of the housing 72 with the drill string. While the sonde 84 and toolface may be geostationary, the drill bit 18 may rotate to drill a wellbore. For example, drill bit 18 may rotate in a direction 90.

During drilling operations, the housing 72 may not rotate at a constant speed due to disturbances acting on the housing 72 or on the drill bit 18. For example, during a stick-slip situation, the drill bit 18 and housing 72 may rotate in a halting fashion where the drill bit 18 and housing 72 stop rotating at certain times or rotate at varying speeds. As such, the rotational speed of the inner shaft 74 may need to be adjusted during the drilling operation to counteract the effect of the disturbances acting on the housing 72 and to maintain the cam 76 and the sonde 84 rotating equal and opposite of the rotation of the housing 72.

Because disturbances acting on the housing 72 or on the drill bit 18 may occur suddenly, faster responses in the rotational speed of the inner shaft 74 may help reduce toolface error. Therefore, systems that utilize only a prime mover (e.g., turbine) to power rotation of the inner shaft may not be able to respond quickly enough to the changes in rotational speed of the housing. To address this, the disclosed rotary steerable drilling system 22 may include the hybrid drive 68 utilizing both the electrical motor/generator 80 along with the turbine 70 to rotate the inner shaft 74. The motor/generator 80 may provide the acceleration and/or deceleration needed to follow the disturbance in rotational speed of the housing 72.

The rotary steerable drilling system 22 may also include a control system 92 communicatively coupled to the electrical motor/generator 80. The control system 92 may provide close control of the electrical motor/generator 80 so that the rotation of the inner shaft 74 matches any high frequency changes in the rotation of the housing 72, in response to disturbances acting on the housing 72 or on the drill bit 18. The control system 92 may be communicatively coupled to one or more sensors (e.g., gravitometer, accelerometer, magnetometer) (not expressly shown) along the rotary steerable drilling system 22, these sensors being capable of detecting disturbances acting on the housing 72 or on the drill bit 18. In response to detecting these disturbances, the control system 92 may adjust a speed or operating mode of the electrical motor/generator 80, thereby changing the rotational speed of the inner shaft 74 (and consequently the cam 76) by way of the electrical motor/generator 80 and the turbine 70. Therefore, the control system 92 may be capable of making quick adjustments to the rotational speed of the electrical motor/generator 80 to assist in maintaining the sonde 84 at a geostationary position and minimizing toolface error at the drill bit 18.

In some embodiments, the control system 92 may use pulse width modulation to adjust the speed or operating mode of the motor/generator 80. Instead of, or in addition to, gradual analog control signals, the control system 92 may use digital steps with pulse width modulation. Pulse width modulation may reduce toolface error at the drill bit 18 by improving the response time of the rotary steerable drilling system 22 to control signals from control system 92. Additionally, the digital steps used with pulse width modulation control signals may be implemented with Digital Signal Processing (DSP) micro controllers, which may allow for quick response times for detecting and responding to toolface error.

Figure 3:
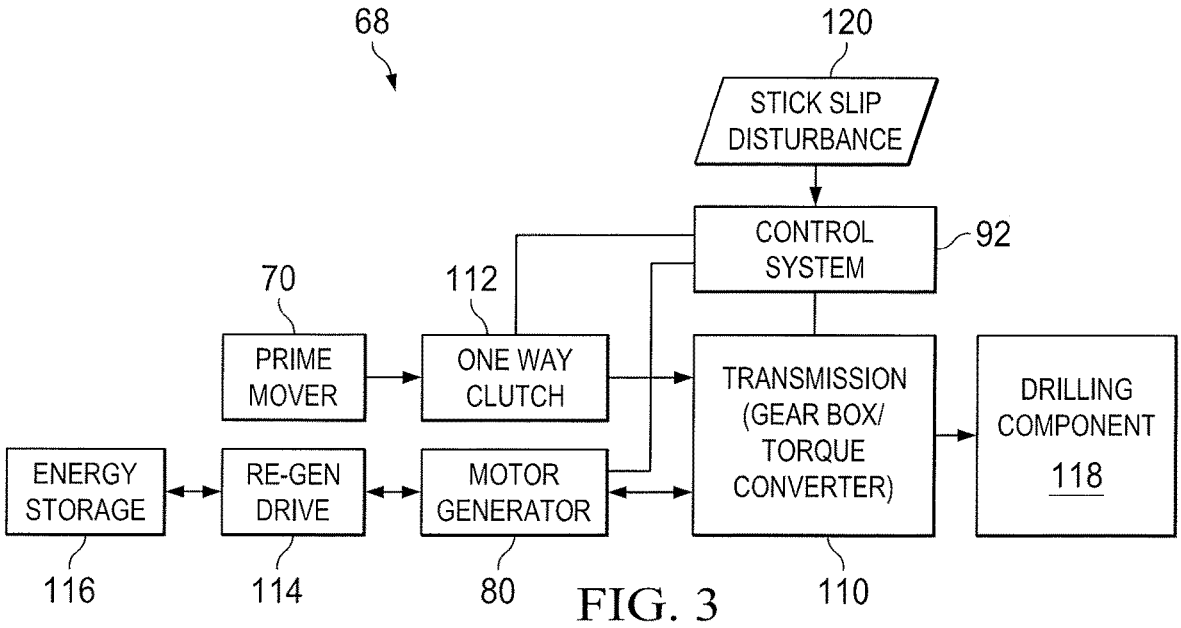
FIG. 3 is a schematic diagram of components of a hybrid drive for use in a fully rotating rotary steerable tool, in accordance with an embodiment of the present disclosure.

FIG. 3 provides a detailed view of the power train used by the hybrid drive 68 within the rotary steerable drilling system. The hybrid drive 68 may include the prime mover (e.g., turbine) 70, the motor/generator 80, a transmission 110, the control system 92, a one-way clutch 112, a regenerative drive 114, and an energy storage device 116. It should be noted that other components and arrangements thereof may be utilized in other embodiments of the hybrid drive 68.

The prime mover 70 may provide rotational power to generally follow a rotational speed of the fully rotating housing of the rotary steerable drilling system 22 of FIG. 2. The prime mover 70 may be designed to rotate at a speed that is proportional to an expected average rotational speed of the rotating housing under certain operational parameters. In embodiments where the prime mover 70 is a turbine that may be rotated in response to drilling mud flowing past the turbine, the drilling mud may be directed through the tool at a speed that facilitates this proportional speed of the turbine. The prime mover 70 may include any desirable electro-hydro-mechanical system, such as a turbine, impeller, or other motoring apparatus.

As mentioned above, the motor/generator 80 may be operated as a motor to supplement the speed of rotation provided by the prime mover 70. That is, the motor/generator 80 may provide quick acceleration within the hybrid drive 68 when needed to follow disturbances in the rotational speed of the fully rotating housing, as detected by sensors within the rotary steerable system. The same motor/generator 80 may operate as a generator 80 at other times to decelerate the rotation of the inner shaft for matching a slower rotation of the housing. Thus, the motor/generator 80 may be selectively controlled to adjust the speed of rotation of the inner shaft to maintain a drilling component 118 (e.g., cam 76, sonde 84, or drill bit 18 of FIG. 2) geostationary with respect to the subterranean formation.

The control system 92 may receive a signal 120 indicative of a rotational speed of the housing detected via one or more sensors in the rotary steerable system. As illustrated, this signal 120 may indicate a disturbance (e.g., stick-slip disturbance) in the rotational speed of the housing. The control system 92 may be communicatively coupled to one or more of the motor/generator 80, the transmission 110, and the one-way clutch 112, providing control signals for operating these components in response to the sensor feedback. The control system 92 may automatically control the speed and position of the drilling component 118 (e.g., cam) using the prime mover 70 and the motor/generator 80.

The motor/generator 80 may be controlled to function as either a motor or a generator. In some embodiments, the motor/generator 80 may be a permanent magnetic synchronous generator/motor (PMSG). When acting as a motor, the motor/generator 80 may convert electrical energy from the energy storage device 116 into mechanical energy for rotating the inner shaft of the rotary steerable system, thereby accelerating rotation of the shaft. When acting as a generator, the motor/generator 80 may convert rotational energy from the rotating inner shaft into electrical energy for storage in the energy storage device 116, thereby decelerating rotation of the shaft. The motor/generator 80 may be operated according to instructions from the control system 92 to provide sudden acceleration and deceleration in response to high frequency changes in the detected rotational velocity of the outer housing. Since the motor/generator 80 is electrically controlled, it can respond much quicker than the hydro-mechanical powered prime mover 70.

As mentioned above, the hybrid drive 68 may include a one-way clutch 112 disposed between the prime mover 70 and the transmission 110. The clutch 112 may enable power to be transferred between the prime mover 70 and the transmission in just one direction. The clutch 112 may be utilized to selectively engage or disengage the prime mover 70 (e.g., rotating turbine) from the transmission 110. Disengaging the prime mover 70 from the transmission 110 may enable the motor/generator 80 to efficiently output rotational energy to accelerate the rotation of the inner shaft. By disconnecting the prime mover 70 from the transmission 110 via the clutch 112 in such instances, all the power being directed from the motor/generator 80 may go directly through the transmission 110 and to the drilling component 118, instead of into the prime mover 70.

The motor/generator 80 may be operated with the regenerative drive 114 to regenerate and store power (from a deceleration of the rotating inner shaft) in the energy storage device 116. By generating and storing power in the energy storage device 116, the hybrid drive 68 may facilitate a reduction in the size of a power generator needed for operating electronics downhole. That is, the energy storage device 116 may be used to power downhole electronics in the rotary steerable drilling system, using energy regenerated from the inner rotating shaft. The energy storage device 116 may include one or more super-capacitors, capacitors, or rechargeable batteries. The regenerative drive 114 provided in the hybrid drive 68 may be any desirable regenerative drive, such as those used in commercial motor applications.

Figure 4:
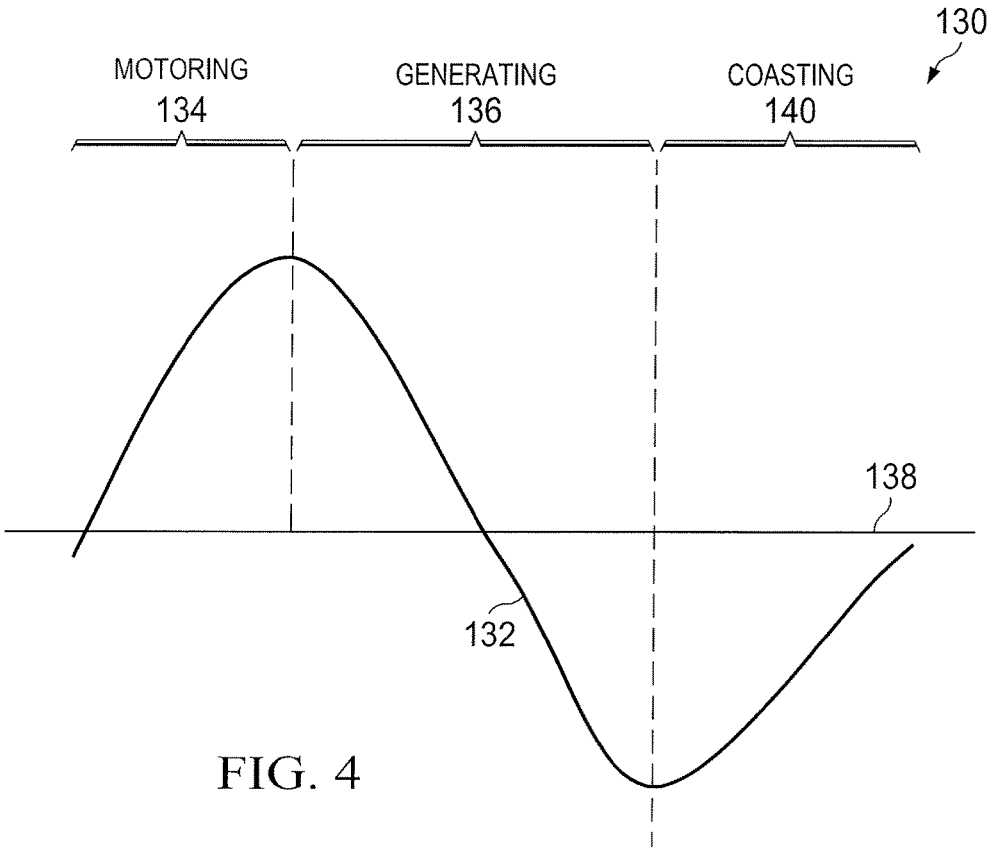
FIG. 4 is a plot illustrating modes of operation of a motor/generator used in the hybrid drive of FIG. 3, in accordance with an embodiment of the present disclosure.

FIG. 4 is a plot 130 illustrating different modes of operation for the motor/generator during operation of the disclosed rotary steerable drilling system. A trend line 132 shown in the plot 130 may represent the changing rotational speed of the housing of the rotary steerable tool under stick-slip conditions. Therefore, the motor/generator may be controlled to operate in different modes depending on the speed of rotation that needs to be matched by the rotating cam at different times during the stick-slip event.

As illustrated, when the rotational speed needs to be increased, the motor/generator may be operated in a motoring mode 134 to accelerate the rotation of the inner shaft. In such instances, the one-way clutch may be used to decouple the prime mover from the transmission during this mode of operation, so that all the energy available from the motor/generator may be sent directly to the transmission to rotate the cam, and not to the prime mover.

After this acceleration, the rotational speed may go down as shown. At this point, the motor/generator may be operated in a generating mode 136 to decelerate the rotation of the inner shaft. In the generating mode 136, the motor/generator may be operated as a generator to convert rotational energy from the shaft into electrical energy for storage within the rotary steerable drilling system. Thus, the motor/generator may be able to reduce the speed of rotation of the inner shaft as energy is diverted from the shaft into the generator. During this generating mode 136, the one-way clutch may be actuated to selectively engage or disengage the prime mover from the inner shaft, depending on the desired speed of rotation of the shaft.

When the housing begins to rotate faster again, but is below an average or expected rotational speed value 138, the motor/generator may be operated in a coasting mode 140. In the coasting mode 140, the motor/generator may not be converting energy from electrical to mechanical (e.g., motor) or from mechanical to electrical (e.g., generator). Instead, the motor/generator may coast, allowing the power output by the prime mover to bring the rotational speed of the cam back toward the average or expected rotational speed value 138. Other arrangements of operating modes and control schemes may be implemented via the control system to match the rotational speed of the cam and sonde with the rotational speed of the outer housing.

Figure 5:
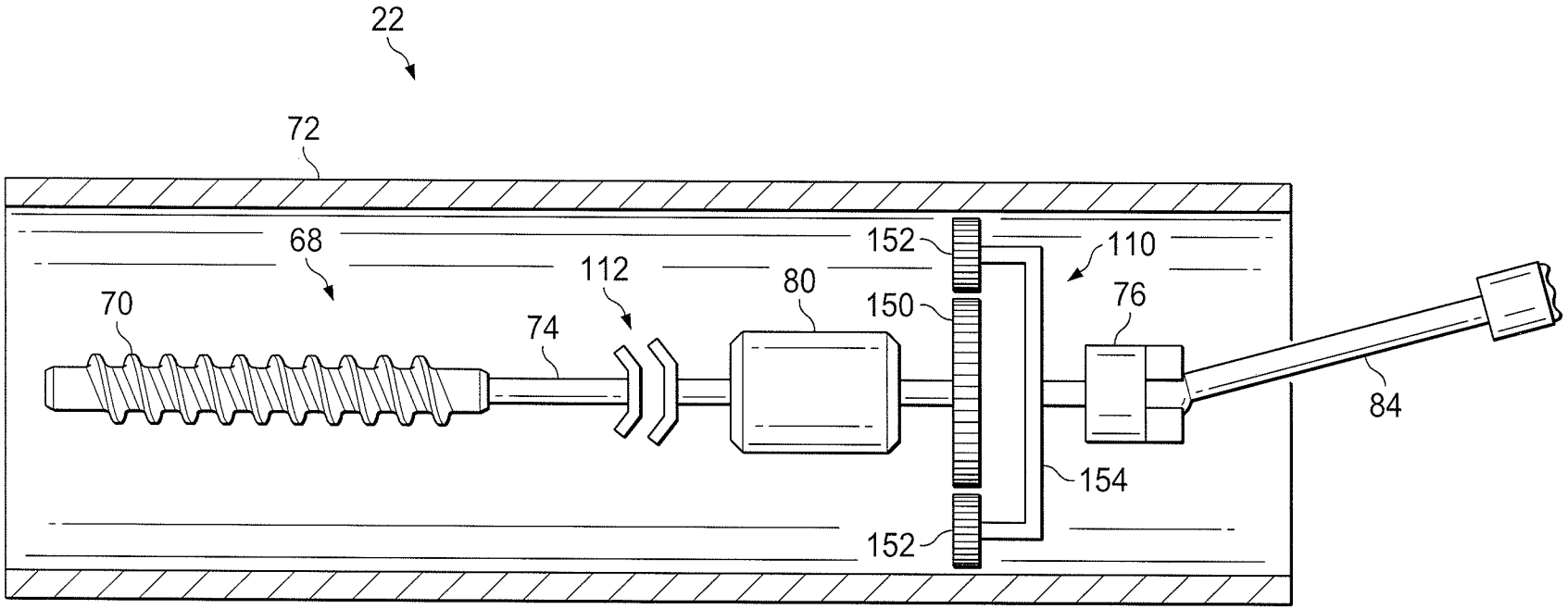
FIG. 5 is a schematic illustration of components of a fully rotating rotary steerable tool equipped with the hybrid drive of FIG. 3, in accordance with an embodiment of the present disclosure.

FIG. 5 schematically illustrates an embodiment of the rotary steerable drilling system 22 including the hybrid drive 68. As illustrated, the motor/generator 80 may be disposed on the same shaft (e.g., inner shaft 74) as the prime mover 70. In other embodiments, however, the motor/generator 80 may be disposed as a separate assembly connected to the transmission 110 via a separate shaft from the prime mover 70. The one-way clutch 112 may enable power to be directed from the prime mover 70 to the rest of the mechanical system when the clutch 112 is actuated to engage the prime mover 70 with the transmission 110. In embodiments where the prime mover 70 and the motor/generator 80 are disposed along a single shaft 74, the components should generally be assembled along the shaft 74 in the order shown. That is, the motor/generator 80 may be positioned closer than the prime mover 70 to the transmission 110, and the one-way clutch 112 may be disposed between the prime mover 70 and the motor/generator 80. That way, decoupling the prime mover 70 from the transmission 110 via the clutch 112 does not prevent acceleration or deceleration provided via the motor/generator 80 from reaching the transmission 110.

The transmission 110 may be geared to provide a desired speed of rotation to the drilling components (e.g., cam 76 and sonde assembly 84) based on the rotational speed provided by the prime mover 70 and/or the motor/generator 80. As illustrated, the transmission 110 may include a planetary gearbox, although it should be noted that other embodiments may include different types of transmissions. In the illustrated transmission 110, a central sun gear 150 may be attached to the single shaft 74 used to couple the prime mover 70 and the motor/generator 80 to the transmission 110. Multiple planet gears 152 may be positioned around the outside of and in engagement with the sun gear 150. The planet gears 152 may be arranged in a carrier 154 that is coupled to the cam 76, sonde assembly 84, and/or other downhole drilling components.

Again, the disclosed hybrid drive 68 may enable the use of the motor/generator 80 to supplement rotation provided by the prime mover 70 (e.g., turbine). This may be particularly desirable when the hybrid drive 68 is used to rotate the inner shaft 74 at a speed matching a rotational speed of the outer housing 72 of the assembly. The fast response time of the motor/generator 80 may enable relatively accurate speed matching, in order to maintain certain drilling components in a geostationary orientation. The same motor/generator 80 may also be used to regenerate and store electrical power for future motoring. Thus, the disclosed hybrid drive may have relatively low energy requirements for matching the motion of the fully rotating housing 72.

Embodiments disclosed herein include:

A. A rotary steerable drilling system including a prime mover for outputting mechanical energy to rotate a drilling component of the rotary steerable tool, an electrical motor/generator, and a transmission coupled to both the prime mover and the motor/generator for providing mechanical energy from one or both of the prime mover and the motor/generator to rotate the drilling component of the rotary steerable drilling tool.

B. A method including rotating a housing of a fully rotating rotary steerable drilling system relative to a subterranean formation and maintaining a drilling component of the fully rotating rotary steerable drilling system geostationary with respect to the subterranean formation by rotating the drilling component opposite the housing via a hybrid drive. The hybrid drive includes a prime mover, an electrical motor/generator, and a transmission coupled to both the prime mover and the motor/generator for providing mechanical energy from one or both of the prime mover and the motor/generator to rotate the drilling component.

C. A method including rotating a drilling component of a rotary steerable drilling system via a prime mover coupled to a transmission of the rotary steerable drilling system, converting electrical energy to mechanical energy via a motor/generator coupled to the transmission and operating in a motoring mode to accelerate rotation of the drilling component, and regenerating electrical energy via the motor/generator operating in a generator mode within the rotary steerable drilling system.

Each of the embodiments A, B, and C may have one or more of the following additional elements in combination. Element 1: wherein the rotary steerable tool is a fully rotating downhole tool. Element 2: wherein the drilling component includes a cam used to rotate a drill bit with respect to a rotating housing of the rotary steerable tool to keep the drill bit geostationary to a subterranean formation while the housing rotates during drilling. Element 3: further including a sensor for detecting disturbances in rotation of the rotating housing, and a control system communicatively coupled to the sensor and to the electrical motor/generator for operating the electrical motor/generator in response to the disturbances detected by the sensor. Element 4: wherein the prime mover includes a turbine for converting energy from mud flowing through the rotary steerable tool to rotational energy. Element 5: wherein the electrical motor/generator includes a permanent magnet synchronous generator/motor. Element 6: further including a one-way clutch for selectively engaging and disengaging the prime mover from the transmission. Element 7: wherein the prime mover and the electrical motor/generator are disposed along a single shaft coupled to the transmission. Element 8: wherein the electrical motor/generator is disposed along the single shaft between the prime mover and the transmission, and wherein the a one-way clutch is disposed along the single shaft between the prime mover and the electrical motor/generator. Element 9: further including a regenerative drive coupled to the electric motor/generator for providing electrical energy generated by the electric motor/generator to an energy storage component of the rotary steerable tool.

Element 10: further including receiving a signal indicative of a rotational speed of the housing at a control system, and operating the motor/generator to match changes in the rotational speed of the housing to maintain the drilling component geostationary with respect to the subterranean formation based on the signal via the control system. Element 11: further including actuating a clutch to selectively engage or disengage the prime mover from the transmission. Element 12: further including converting rotational energy into electrical energy via the electrical motor/generator and a regenerative drive to store the electrical energy in the fully rotating rotary steerable drilling system. Element 13: further including rotating the prime mover by rotating a turbine via mud flow through the fully rotating rotary steerable drilling system.

Element 14: further including operating the motor/generator to supplement rotation of the prime mover to keep the drilling component geostationary with respect to a subterranean formation as the rotary steerable drilling system rotates. Element 15: further including actuating a clutch to selectively engage or disengage the prime mover from the transmission. Element 16: further including recharging an energy storage device via the electrical energy regenerated via the motor/generator. Element 17: further including powering electronics of the rotary steerable drilling system via the electrical energy in the energy storage device.

Although the present disclosure and its advantages have been described in detail, it should be understood that various changes, substitutions and alterations can be made herein without departing from the spirit and scope of the disclosure as defined by the claims.

What is claimed is:

1. A rotary steerable drilling system, comprising:

a prime mover for outputting mechanical energy to rotate a drilling component of the rotary steerable tool;

an electrical motor/generator;

a transmission coupled to both the prime mover and the motor/generator for providing mechanical energy from one or both of the prime mover and the motor/generator to rotate the drilling component of the rotary steerable drilling tool; and a control system that selectively switches operation of the rotary steerable drilling system between a first mode in which the prime mover alone provides rotational energy to the transmission and at least one other mode in which the motor/generator provides rotational energy to the transmission.

2. The rotary steerable drilling system of claim 1, wherein the rotary steerable tool is a fully rotating downhole tool.

3. The rotary steerable drilling system of claim 2, wherein the drilling component comprises a cam used to rotate a drill bit with respect to a rotating housing of the rotary steerable tool to keep the drill bit geostationary to a subterranean formation while the housing rotates during drilling.

4. The rotary steerable drilling system of claim 3, further comprising a sensor for detecting disturbances in rotation of the rotating housing, wherein the control system is communicatively coupled to the sensor and to the electrical motor/generator for operating the electrical motor/generator in response to the disturbances detected by the sensor.

5. The rotary steerable drilling system of claim 1, wherein the prime mover comprises a turbine for converting energy from mud flowing through the rotary steerable tool to rotational energy.

6. The rotary steerable drilling system of claim 1, wherein the electrical motor/generator comprises a permanent magnet synchronous generator/motor.

7. The rotary steerable drilling system of claim 1, further comprising a one-way clutch for selectively engaging and disengaging the prime mover from the transmission.

8. The rotary steerable drilling system of claim 1, further comprising:

a housing, wherein the prime mover, the electrical motor/generator, and the transmission are disposed within the housing; and a shaft disposed in the housing and directly connected to the transmission, wherein the prime mover and the electrical motor/generator are disposed along the shaft.

9. The rotary steerable drilling system of claim 8, wherein the electrical motor/generator is disposed along the shaft between the prime mover and the transmission, and wherein a one-way clutch is disposed along the shaft between the prime mover and the electrical motor/generator.

10. The drilling system of claim 1, further comprising a regenerative drive coupled to the electric motor/generator for providing electrical energy generated by the electric motor/generator to an energy storage component of the rotary steerable tool.

11. The rotary steerable drilling system of claim 1, wherein the control system selectively switches operation of the rotary steerable drilling system between the first mode in which the prime mover alone provides rotational energy to the transmission, a second mode in which the motor/generator alone provides rotational energy to the transmission, and a third mode in which the prime mover and the motor/generator together provide rotational energy to the transmission.

12. A method, comprising:

rotating a housing of a fully rotating rotary steerable drilling system relative to a subterranean formation;

maintaining a drilling component of the fully rotating rotary steerable drilling system geostationary with respect to the subterranean formation by rotating the drilling component opposite the housing via a hybrid drive, wherein the hybrid drive comprises:

a prime mover;

an electrical motor/generator; and a transmission coupled to both the prime mover and the motor/generator for providing mechanical energy from one or both of the prime mover and the motor/generator to rotate the drilling component; and controlling operation of the rotary steerable drilling system to selectively switch between a first mode in which the prime mover alone provides rotational energy to the transmission and at least one other mode in which the motor/generator provides rotational energy to the transmission.

13. The method of claim 12, further comprising:

receiving a signal indicative of a rotational speed of the housing at a control system; and operating the motor/generator to match changes in the rotational speed of the housing to maintain the drilling component geostationary with respect to the subterranean formation based on the signal via the control system.

14. The method of claim 12, further comprising actuating a clutch to selectively engage or disengage the prime mover from the transmission.

15. The method of claim 12, further comprising converting rotational energy into electrical energy via the electrical motor/generator and a regenerative drive to store the electrical energy in the fully rotating rotary steerable drilling system.

16. The method of claim 12, further comprising rotating the prime mover by rotating a turbine via mud flow through the fully rotating rotary steerable drilling system.

17. A method, comprising:

rotating a drilling component of a rotary steerable drilling system via a prime mover coupled to a transmission of the rotary steerable drilling system;

converting electrical energy to mechanical energy via a motor/generator coupled to the transmission and operating in a motoring mode to accelerate rotation of the drilling component;

regenerating electrical energy via the motor/generator operating in a generator mode within the rotary steerable drilling system; and controlling operation of the rotary steerable drilling system to selectively switch between a first mode in which the prime mover alone provides rotational energy to the transmission and at least one other mode in which the motor/generator provides rotational energy to the transmission.

18. The method of claim 17, further comprising operating the motor/generator to supplement rotation of the prime mover to keep the drilling component geostationary with respect to a subterranean formation as the rotary steerable drilling system rotates.

19. The method of claim 17, further comprising actuating a clutch to selectively engage or disengage the prime mover from the transmission.

20. The method of claim 17, further comprising recharging an energy storage device via the electrical energy regenerated via the motor/generator, and powering electronics of the rotary steerable drilling system via the electrical energy in the energy storage device.

* * * * *